US005153066A

United States Patent [19]

Tanaka et al.

[11] Patent Number: 5,153,066

[45] Date of Patent: Oct. 6, 1992

[54] TEMPERATURE-SENSITIVE COLOR-CHANGEABLE COMPOSITE FIBER

[75] Inventors: Kazuhiko Tanaka; Masao Kawamoto, both of Kurashiki; Kenji Hiramatsu, Otsu; Tsutomu Kito, Tajimi; Kuniyuki Senga, Kasugai, all of Japan

[73] Assignees: Kuraray Co., Ltd., Okayama; Pilot Ink Co., Ltd., Nagoya, both of Japan

[21] Appl. No.: 555,608

[22] Filed: Jul. 23, 1990

[30] Foreign Application Priority Data

Jul. 25, 1989 [JP] Japan ..... 1-193663
Dec. 14, 1989 [JP] Japan ..... 1-325165

[51] Int. Cl.[5] ..... D02G 3/00
[52] U.S. Cl. ..... 428/373
[58] Field of Search ..... 428/373, 372

[56] References Cited

U.S. PATENT DOCUMENTS 3,616,183 10/1971 Brayford et al. ..... 428/373
3,679,541 7/1972 Davis et al. ..... 428/373
4,420,534 12/1983 Matsui et al. ..... 428/373 X
4,681,791 7/1987 Shibahashi et al. ..... 428/372 X

FOREIGN PATENT DOCUMENTS 2176050 10/1973 France .
83932 6/1984 Japan .
83985 6/1984 Japan .
177254 4/1987 Japan .
42937 2/1988 Japan .

OTHER PUBLICATIONS

Patent Abstracts of Japan vol. 14, No. 318 (C-738)(4261), Jul. 9, 1990.
Patent Abstracts of Japan, vol. 11, No. 381 (C-464)(2828), Dec. 12, 1987.
Database WPIL, Accession No. 87-354874 (36) & JP-6-2-177254 (Aug. 4, 1987).
Database WPI, Accession No. 79-779538 (43) & JP-5-4-117548 (Sep. 12, 1979).

*Primary Examiner*—Patrick J. Ryan
*Assistant Examiner*—Richard C. Weisberger
*Attorney, Agent, or Firm*—Fitzpatrick, Cella, Harper & Scinto

[57] ABSTRACT

A temperature-sensitive color-changeable composite fiber wherein (A) a thermally color-changeable polymer phase (phase A) composed essentially of a thermally color-changeable material and a thermoplastic polymer having a melting point or a softening point of 230° C. or lower, the content of the thermally color-changeable material being 0.5 to 90% by weight and (B) a protective polymer (phase B) composed essentially of a fiber-forming thermoplastic polymer are brought into contact with each other, (i) the protective polymer phase (phase B) occupying at least 60% of the fiber surface area, and (ii) the protective polymer phase (phase B) occupying 20 to 95% by weight relative to the overall fiber. The composite fiber of this invention has reversibly thermally color-changeable performance of excellent temperature-sensitive color-changeability, color vividness, washing durability and light resistance.

9 Claims, 1 Drawing Sheet

TEMPERATURE-SENSITIVE COLOR-CHANGEABLE COMPOSITE FIBER

INDUSTRIAL FIELD OF UTILIZATION

This invention relates to a temperature-sensitive color-changeable composite fiber, and more specifically to a reversibly thermally color-changeable composite fiber excellent in temperature-sensitive color-changeability, color vividness in color change, washing durability and light resistance.

PRIOR ART

Reversibly thermally color-changeable fibers with reversibly thermally color-changeable materials adhered to fiber surfaces have been hitherto known. However, as the thermally color-changeable materials adhered to the surfaces are easy to detach, such fibers are poor in washing durability and less practical. Meanwhile, reversibly thermally color-changeable fibers are also known wherein fiber-forming polymers contain reversibly thermally color-changeable materials. Nevertheless, said fibers suffer several problems from the practical standpoint. That is, the reversibly thermally color-changeable materials achieve the effects for the first time when pigments and composite materials used in combination exhibit their respective performances at the same time. However, in the reversibly thermally color-changeable materials known to date, heat resistance of the reversibly thermally color-changeable materials is low so that the use of the thermally color-changeable materials is actually limited, when incorporated into the fiber-forming polymers, owing to their melting point. For instance, there is no problem when the thermally color-changeable materials are incorporated into relatively low-melting polymers such as polyethylene and polypropylene. Nevertheless, when they are incorporated into relatively high-melting polymers such as polyesters widely used in common clothes, the composite materials cause decrease in performance due to a heat, making it impossible to exhibit the reversible thermal color-changeable performance.

As a means for improving such defect of heat resistance found in the thermally color-changeable materials, it has been proposed that the thermally color-changeable materials are microcapsulated. However, when the microcapsulated thermally color-changeable materials are incorporated into the polymers and fiberized in a usual manner, stability in a fiberization step is insufficient. Even though such fibers are obtained, the thermally color-changeable materials present in the fiber surface layers are damaged and dropped off by bending, pulling and rubbing when in practical use as well as by washing, and are poor in light resistance, resulting in decrease in reversible thermal color-changeability and color formability even in practical use.

In addition, the microcapsulated thermally color-changeable materials, unlike common pigments, have a large particle size (1 to 30 micrometers) and are low in chromatic concentration. Accordingly, to obtain a desirable concentration by mere mixing, their amounts must be at least 10 times those of the common pigments. The particles of the microcapsulated thermally color-changeable materials are, because of their large particle size, exposed in large amounts to the fiber surfaces to make the fiber surfaces uneven; such uneven fiber surfaces permit diffused reflection of light, causing a whitening phenomenon of the fiber appearance.

What is more, when the fibers containing therein the thermally color-changeable materials are formed by an ordinary method in which the melt of the fiber-forming polymers containing the thermally color-changeable materials is spun by jetting it from a nozzle to air, the thermally color-changeable materials in the fiber surfaces which are important in color formation are degraded by evaporation, sublimation, oxidation, etc. under high temperature conditions in spinning, which results in decrease in color-changeability.

Problems the Invention Seeks to Solve

It is a first object of this invention to provide a temperature-sensitive color-changeable fiber excellent in reversible color-changeability and color vividness in color change.

A second object of this invention is to provide a fast, highly practical, temperature-sensitive color-changeable fiber excellent in washing durability and light resistance.

Another object of this invention is to provide a temperature-sensitive color-changeable fiber substantially free from surface unevenness and having less decrease in color vividness by whitening phenomenon.

Still another object of this invention is to provide a temperature-sensitive color-changeable fiber having a structure that can be obtained by a method which does not experience any trouble in a fiberization step and is almost free from decrease in performance of a thermally color-changeable material under a high temperture atmosphere in fiberization.

The other objects of this invention will be clarified from the following explanation.

Means for Solving the Problems

According to the studies of the present inventors, it is found that the objects and advantages of this invention can be achieved by a temperature-sensitive color-changeable composite fiber wherein (A) a thermally color-changeable polymer phase (phase A) composed essentially of a thermally color-changeable material and a thermoplastic polymer having a melting point or a softening point of 230° C. or lower, the content of the thermally color-changeable material being 0.5 to 90% by weight and (B) a protective polymer phase (phase B) composed essentially of a fiber-forming thermoplastic polymer are brought into contact with each other, (i) the protective polymer phase (phase B) occupying at least 60% of the fiber surface area, and (ii) the protective polymer phase (phase B) occupying 20 to 95% by weight relative to the overall fiber.

The basic idea of such temperature-sensitive color-changeable fiber in this invention is that in order to incorporate the reversibly thermally color-changeable material into the fiber, the composite fiber is composed of two phases, i.e. the polymer phase (phase A) containing the thermally color-changeable material and the fiber-forming polymer phase (phase B), and is of such structure that the phase A is surrounded by the phase B as much as possible. The conventional drawbacks and problems could have thereby been solved entirely.

The temperature-sensitive color-changeable composite fiber and the process for producing same in this invention will be hereinafter explained in detail.

The thermally color-changeable material used in this invention is known per se. It is a pigment that forms, changes or loses a color by temperature change. Examples of such material are a thermally color-changeable pigment composed of three components, i.e. an electron-donating chromatic organic compound, an electron-accepting compound and a compound as a reaction medium of the above compounds, and a thermally color-changeable pigment in which the resin solid solution of the above three components takes a form of fine particles.

Preferable thermally color-changeable materials are described in U.S. Pat. No. 4,028,118 (corresponding to Japanese Patent Publication Nos. 44,706/76, 44,707/76, 44,708/76 and 44,709/76), U.S. Pat. No. 4,732,810 (corresponding to Japanese Patent Publication No. 29,398/89) and U.S. Pat. No. 4,865,648 (corresponding to Japanese Laid-open Patent Application No. 264,285/85).

A mechanism that the thermally color-changeable material changes a color with a heat is not necessarily clarified, but presumed as follows. As stated above, the thermally color-changeable material is composed of the three components, i.e. the electron-donating chromatic organic compound being a pigment that forms a color when losing an electron, the electron-accepting organic compound that deprives an electron from the organic compound, and the reaction medium that is melted or solidified with a fixed temperature as a boundary. At a low temperature, the electron-accepting compound is bound to the electron-donating chromatic organic compound in the solidified reaction medium and deprives an electron therefrom to form a color. Meanwhile, at a high temperature, the reaction medium is melted, and the electron-accepting compound returns the electron to the electron-donating chromatic organic compound and is separated from the electron-donating chromatic organic compound, so that the color disappears. The color formation temperature is determined in many cases by a melting point of the reaction medium.

The electron-donating chromatic organic compound is at least one compound selected from diaryl phthalides, indolyl phthalides, polyaryl carbinols, leuco auramines, acyl auramines, aryl auramines, rhodamine B lactams, indolines, spiropyrans and fluorans.

The electron-accepting compound is at least one compound selected from phenolic compounds, metal salts of the phenolic compounds, aromatic carboxylic acids, aliphatic carboxylic acids, metal salts of carboxylic acids, acidic phosphoric esters, metal salts of the acidic phosphoric esters and triazole compounds.

The reaction medium is at least one compound selected from alcohols, ethers, ketones, esters and amides.

To form the thermally color-changeable material into a pigment, it is advisable that said material is enveloped in a microcapsule by a known microcapsulating technique. A particle size of the microcapsule is 1 to 30 micrometers, preferably 5 to 20 micrometers. Examples of the microcapsulating technique are interfacial polymerization, in situ polymerization, curing and coating in a liquid, phase separation from an aqueous solution, phase separation from an organic solvent, melt dispersion and cooling, coating by suspension in gas, and spray drying. They may properly be selected depending on the use.

The thermoplastic polymer forming the thermally color-changeable polymer phase (phase A) in this invention has to have a melting point or a softening point of 230° C. or lower. When a polymer having a melting point or a softening point of higher than 230° C. is used and melt-mixed with the thermally color-changeable material, a decomposed gas considered ascribable to the heat resistance is generated and color-changeability decreases, making it substantially difficult to provide a uniform mixture of the polymer and the thermally color-changeable material. The preferable melting point or softening point of the thermoplastic polymer is about 120° C. to 200° C.

Examples of the thermoplastic polymer forming the component A are polyolefins such as high-density polyethylene (HDPE), medium-density polyethylene (LLDPE), low-density polyethylene (LDPE), polypropylene, modified polyethylene and modified polypropylene; and polyamides such as nylon 12, nylon 11, nylon 6 and nylon elastomer. They may be a homopolymer, a copolymer or a mixed polymer of two or more.

In this invention, the amount of the thermally color-changeable material contained in the thermally color-changeable polymer phase (phase A) is 0.5 to 90% by weight, preferably 1 to 70% by weight, more preferably 5 to 40% by weight, based on the overall weight of the thermally color-changeable polymer phase (phase A). When the content of the thermally color-changeable material is less than 0.5% by weight, a composite fiber using the above material does not give desirable color-changeability and a color concentration, making it impossible to show sufficient thermal color-changeability. Meanwhile, even if it exceeds 90% by weight, color-changeability does not improve at all, and flowability of the thermally color-changeable polymer phase notably decreases, with the result that spinnability extremely worsens and a pack life is quite shortened by filter clogging, etc. to decrease stability of a fiberization step. Thus, either case is unwanted.

The composite fiber of this invention comprises said phase A and the protective polymer phase (phase B) composed essentially of the fiber-forming thermoplastic polymer. As the polymer of the protective polymer phase (phase B), any polymer will do if it has a melting point of 120° C. or higher and is of good fiberizability. In consideration of heat resistance of the color-changeable material, the melting point is preferably 230° C. or lower. However, at the melting point of higher than the above, fibers can be formed if the structure in the pack is properly arranged.

Moreover, as the protective polymer layer (phase B) plays an important role to keep good fiberizability, a polymer having poor spinnability is basically unsuited for the purpose of this invention.

If the protective polymer phase (phase B) in the composite fiber of this invention is only for protecting the phase A surrounded thereby, it is considered that as the polymer of the phase B, a highly transparent amorphous polymer is used to develop the vivid color of the thermally color-changeable polymer. Actually, however, the amorphous polymer as the phase B is fairly inferior in spinnability and performance of the resulting fibers.

Accordingly, a crystalline polymer which is a bit inferior in transparency to the amorphous polymer but excellent in spinnability and performance of the resulting fibers, i.e. a fiber-forming polymer, is preferable as the polymer of the phase B. As the polymer of the phase B, polyesters or polyamides are especially preferable.

Examples of the polyesters are fiber-forming polyesters formed from aromatic dicarboxylic acids such as terephthalic acid, isophthalic acid, naphthalene-2,6-dicarboxylic acid, phthalic acid, alpha,beta-(4-carboxyphenoxy)ethane, 4,4'-dicarboxydiphenyl, 5-sodiumsulfoisophthalic acid, aliphatic dicarboxylic acids such as adipic acid and sebacic acid and their esters; and diols such as ethylene glycol, diethylene glycol, 1,4-butanediol, 1,6-hexanediol, neopentyl glycol, cyclohexane-1,4-dimethanol, polyethylene glycol and polytetramethylene glycol. Preferable are polyesters wherein 60 mol% or more of the recurring units are ethylene terephthalate units, butylene terephthalate units or hexamethylene terephthalate units. The polyesters may contain small amounts of ordinary additives, fluorescent brighteners and stabilizers.

Examples of the polyamides are nylon 6, nylon 66, nylon 12, and polyamide formed from m-xylylenediamine and adipinic acid. A polyamide containing a small amount of a third component will do. Of cource, the polyamides may contain small amounts of additives, fluorescent brighteners and stabilizers.

A combination of polymers, i.e. polybutylene terephthalate polymers as the polymers of the phases A and B, and a third component being copolymerized such that the melting point of the polymer of the phase A is lower than that of the polymer of the phase B, is preferable in the aspect of fiberizability (i.e. easiness in spinning, stretching and false twisting) and properties (strength and dimensional stability) of the resulting fibers.

Examples of the copolymerization component include dicarboxylic acids such as isophthalic acid, adipic acid, sebacic acid and phthalic acid; and diols such as ethylene glycol, diethylene glycol, propylene glycol and cyclohexane dimethanol. Above all, isophthalic acid is most preferable in the aspect of properties of the fibers.

The polybutylene terephthalate copolymer used as the polymer of the phase B is preferable in the aspect of a melting point and a glass transition point. Examples of the copolymerization component are the same as those of the polymer of the phase A.

Accordingly, most preferable is that isophthalic acid-copolymerized polybutylene terephthalate is used as the polymer of the phase A and isophthalic acid-copolymerized polybutylene terephthalate wherein the content of isophthalic acid is lower than in the polymer of the phase A is used as the polymer of the phase B.

The temperature-sensitive color-changeable composite fiber of this invention is of such structure that the thermally color-changeable polymer phase (phases A) and the protective polymer phase (phase B) are brought into contact with each other, (i) the protective polymer phase (phase B) occupying at least 60% of the fiber surface area, and (ii) the protective polymer phase (phase B) occupying 20 to 95% by weight relative to the overall fiber.

When the protective polymer phase (phase B) in the composite fiber is less than 60% of the fiber surface area, preferable color-changeability and color concentration cannot be provided and sufficient thermal color-changeability is not exhibited. The reason is not necessarily clarified at the present stage; heat resistance of the thermally color-changeable material in a high temperature atmosphere is presumably a great factor. It is preferable that the protective polymer phase (phase B) in the composite fiber of this invention occupies at least 80% of the fiber surface area.

Namely, it is thought that when the phase B is less than 60% of the fiber surface area, the amount of the thermally color-changeable polymer phase (phase A) present in the fiber surface portion increases and the thermally color-changeable material present in the fiber surface portion increases, so that the thermally color-changeable material is more liable to be influenced by the high temperature atmosphere and thermal color-changeability is thus degraded by air. This fact can also be ascertained as follows. That is, as will be later described in Comparative Examples, when the thermally color-changeable polymer phase (phase A) containing the thermally color-changeable material and the fiber-forming protective polymer phase (phase B) are adapted to have such structure contrary to the structure of this invention that the former polymer phase (phase A) is a sheath as the surface layer of the fiber and the latter polymer phase (phase B) is a core, color-formability and color-changeability of the obtained composite fiber are not satisfactory at all.

Since in the composite fiber of this invention the major part of the thermally color-changeable polymer phase (phase A) containing the thermally color-changeable material is covered by the fiber-forming protective polymer phase (phase B) and not exposed to the fiber surface, it is considered disadvantageous at a glance from the standpoint of exhibiting color-formability of the thermally color-changeable material. Such disadvantage is however never seen actually, and the defect of the heat resistance of the thermally color-changeable material under the high temperature atmosphere can be thoroughly conquered.

Besides, the composite fiber of this invention is quite excellent in that performance does not decrease in practical use. Namely, during the long-term use, the fiber is usually repeatedly subjected to harsh bending, pulling, rubbing, washing, rinsing, etc. When the thermally color-changeable material is present in the fiber surface layer, the color-changeable material is, as stated above, necessarily damaged and dropped off. The light resistance is also poor. Consequently, the color-formability and the color-changeability are decreased. On the other hand, as the composite fiber of this invention is of such structure that the thermally color-changeable polymer phase (phase A) is substantially protected with the fiber-forming protective polymer phase (phase B), the above defects are almost eliminated.

The structure of the composite fiber of this invention, when used as a fiber as such, a woven fabric or a knitted fabric, contributes not only to exhibiting the aforesaid excellent performance but also greatly to stability in a fiberization step.

Moreover, the composite fiber of this invention has the structure that the major part of the surface of the thermally color-changeable polymer phase (phase A) is surrounded by the protective polymer phase (phase B) whereby raisings and lowerings in the surface of the phase A of the thermally color-changeable material are covered by the protective polymer. In consequence, the resulting fiber is substantially free from an uneven surface. Therefore, a composite fiber is provided that forms a vivid color without a so-called whitening phenomenon that the uneven surface causes diffused reflection of light and a dull color is given even in color formation.

In the composite fiber of this invention, it is also important that the protective polymer phase (phase B) is 20 to 95% by weight relative to the overall fiber.

When the protective polymer phase (phase B) is more than 95% by weight and the thermally color-changeable polymer phase (phase A) is less than 5% by weight, it becomes hard to spin them in a stable composite fiber structure. On the other hand, when the thermally color-changeable polymer phase (phase A) is more than 80% weight, spinnability and stretchability of the composite fiber and properties of the resulting fiber extremely decrease even if the protective polymer phase (phase B) has sufficient fiberizability, and practicality is extremely lost. The reason is presumably that as the phase A contains the thermally color-changeable material, the thermally color-changeable polymer phase (phase A) notably decreases spinnability and it occupies the major part of the composite fiber so that qualities of the thermally color-changeable polymer phase (phase A) are exhibited as such. Consequently, a weight ratio of the protective polymer phase (B) and the thermally color-changeable polymer phase (phase A) is (B):(A)=20:80 to 95:5, preferably 25:75 to 90:10.

In this invention, in order to more improve durability of temperature-sensitive color-changeability, it is advisable to adsorb or contain a common ultraviolet absorber. Examples of the common ultraviolet absorber are hydroxybenzophenone, hydroxynaphthophenone, phenyl salicylate and benzotriazole. As an adsorbing method, there is, for example, a simple method in which when dyeing the fiber, 1 to 10% owf of the ultraviolet absorber is added to a dye bath in dyeing the fiber and adhered to the fiber at the same time dyeing is conducted. However, it is not neccessary that adsorption is carried out simultaneously with the dyeing. Also available is a method in which the ultraviolet absorber is incorporated in a melt polymer in spinning. The ultraviolet absorber may be added to both the thermally color-changeable polymer phase (phase A) and the protective polymer phase (phase B) or to either one of said two phases. It is preferable that the ultraviolet absorber is contained in the protective polymer phase (phase B). It is advisable to use the ultraviolet absorber in an amount of 0.5 to 5% by weight based on the fiber. The use of the ultraviolet absorber abruptly improves light resistance and durability in temperature-sensitive color-changeability. Even if light is irradiated for 20 hours under the temperature condition of 63° C. by a carbon fadeometer, temperature-sensitive color-changeability of higher than third grade is maintained.

BRIEF DESCRIPTION OF DRAWINGS

FIG. 1 is a typical sheath-core type structure.

FIG. 2 is a structure that some A phases (islands) are present in a matrix of a phase B.

FIG. 3 is a triple structure of B phase—A phase—B phase from the center.

FIG. 4 is a structure that part of the phase A is exposed to the surface in the phase B and present in pot-like or circular form.

FIG. 5 is a structure that the phase B is divided into several blocks by the phase A.

FIG. 6 is a sandwich structure.

Figure 1:
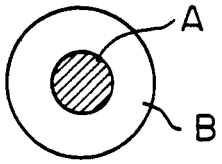
FIGS. 1 to 6 are diagramatic representations of vertically sectional shapes along a longitudinal direction of the composite fiber in this invention.
Figure 2:
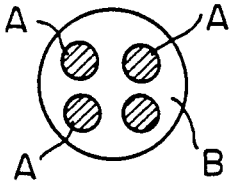
Figure 3:
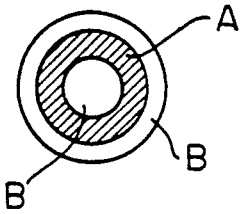

Of these, the structures in FIGS. 1 to 3 wherein the phase A is unexposed to the fiber surface are preferable as the composite fiber of this invention because of little whitening or degradation of the thermally color-changeable material due to the high temperature atmosphere. Especially, the structure in FIG. 1 is advantageous from the standpoint of easiness of production and temperature-sensitive color-changeability.

The vertically sectional structures of the fiber illustrated in FIGS. 1 to 6 are simply for facilitating explanation. The modifications and changes thereof are naturally included in this invention so long as they have the aforesaid characteristics. Moreover, the composite fiber of this invention does not necessarily have a circular section shown in FIGS. 1 to 6, and may be somewhat changed in shape.

The composite fiber of this invention is properly 5 denier or more. When it is less than 5 denier, strength of the resulting composite fiber notably decreases, and if the amount of the temperature-sensitive color-changeable material decreases to stop decrease in strength, vividness of a color comes to be lost. More preferable is 8 denier or more.

The composite fiber of this invention can be formed by a process for producing a composite fiber which is known per se. That is, it is possible that the thermally color-changeable polymer phase (phase A) and the protective polymer phase (phase B) are prepared and formed into a composite fiber in a usual manner.

The fibers can be formed by any method. Examples of the method are a method in which spinning is performed in a usual manner at a speed of 2,500 m/min or less, followed by stretching and heat treatment, a method in which spinning is performed at a speed of 1,500 to 5,000 m/min, followed by stretching and false twisting, and a method in which spinning is performed at a speed of 5,000 m/min or higher and stretching is omitted depending on the use.

The word "fiber" referred to in this invention includes filaments; short fibers; their twisted, processed and spun yarns; and woven, knitted and nonwoven fabrics containing them.

Concrete examples of fiber products using the fiber of this invention are stuffed dolls, doll's dresses, doll's hairs, cottons of christmas trees, sweaters, cardigans, vests, sport shirts, polo shirts, shirts, T-shirts, blouses, suits, blazers, jackets, slacks, skirts, jersey clothes, jumpers, training wears, children's clothing, baby's clothing, student's uniforms, working clothes, coats, raincoats, gowns, pajamas, bathrobes, underwears, swimming suits, ski clothes, their materials, socks, gloves, scarfs, shawls, mufflers, hats, slippers, ties, veils, emblems, handbags, bags, handkerchiefs, towels, blankets, carpets, cushions, moquettes, sheets, artificial flowers, embroidery, laces, ribbons, curtains, table cloths, ropes, sails, tents, hoses, hoods, mountain-climbing boots, rucksacks, lifeboats, packaging cloths, parashutes, belts, nets, false mustaches, false eyelashes, wigs, hair pieces, balls, curtains, heat insulation materials, napkins, lampshades, partition screens, strings, and so forth.

The following Examples and Comparative Examples illustrate the composite fiber of this invention specifically. In said Examples, "parts" are all "parts by weight" unless otherwise indicated.

The properties were measured in accordance with the following methods.

Melting point:

A melting point of a thermoplastic polymer was measured by a differential scanning calorimeter (DSC) at a heating rate of 10° C./min. A temperature at which a heat absorption peak appeared was made the melting point.

Softening point:

A softening point of a thermoplastic polymer was measured in accordance with JIS K 7206-1982.

Washing test method:

A washing test was carried out in accordance with JIS L0217-103. That is, 2 g of a synthetic detergent for clothing was added to 1 liter of water held at 40° C. to form a washing liquid. Into the washing liquid were placed a sample and if required, a load cloth such that a bath ratio reached 1:30, and operation started. After the treatment for 5 minutes, operation stopped, and the sample and the load cloth were dehydrated with a dehydrator. Subsequently, the washing liquid was replaced with a fresh liquid of the above tempearsture. The sample and the load cloth were washed at the same bath ratio for 2 minutes, then dehydrated, rewashed for 2 minutes and dried with air.

EXAMPLE 1

A thermally color-changeable composition comprising crystal violet lactone, bisphenol A and cetyl alcohol was formed into microcapsules having an average particle size of 4 to 15 micrometers by an epoxy resin/amine interfacial polymerization. Twenty parts of the microcapsules were melt-mixed at 160° C. with 80 parts of chips of HDPE (ACE polyethylene F6200V: a tradename for a product of Ace Polymer K.K.) having a melting point of 140° C. The microcapsules having an average particle size of more than 15 micrometers were removed by a filter, and chips (A) containing the thermally color-changeable material were obtained.

Subsequently, the chips (phase A) and polybutylene terephthalate (phase B) (NOVADUR 5008, a tradename for a product of Mitsubishi Chemical Industries, Ltd.: a melting point 230° C.) were melted by separate extruders. Using a composite spinning device, a sheath-core composite yarn in which the phase A was a core and the phase B was a sheath (the sectional view is shown in FIG. 1) and a phase A:phase B composite ratio was 50:50 by weight was spun at 250° C. from 6 holes, and wound up at a spinning rate of 800 m/min to obtain spun filaments of 225 denier/6 filaments.

Subsequently, the spun filaments were stretched 2.5× by a usual stretching machine to afford a stretched yarn of 90 denier/6 filaments. This stretched yarn was further interlaced with a regular polyester yarn of 75 denier/24 filaments at an air pressure of 4 kg/cm$^2$ to provide a thermally color-changeable mixed yarn of 165 denier/30 filaments. The yarns were woven longitudinally transversely into a plane weave by a weaving machine. The flat woven fabric was white above about 40° C. and blue below 40° C., and excellent in color-formability and color-changeability. It did not show a whitish color in color formation. This performance was still kept after repeating the washing test 50 times in accordance with JIS L0217-103, and excellent washing durability was exhibited.

EXAMPLES 2 and 3

Example 1 was repeated except that the polymer in the sheath was replaced with nylon 6 (melting point 225° C.) in Example 2 and polyhexamethylene terephthalate (melting point 149° C.) in Example 3, and the spinning temperature in Example 3 was 200° C.

In both Examples 2 and 3, there were obtained thermally color-changeable fabrics excellent in color-changeability and color-formability, showing no whitish color in color formation and having washing durability.

EXAMPLES 4 and 5

In Example 4, Example 1 was repeated except that 20 parts of the same thermally color-changeable material as used in Example 1 was melt-mixed at 190° C. with 80 parts of chips of polypropylene (K-1800, a tradename for a product of Chisso Corporation) having a melting point of 165° C. to obtain chips containing a color-changeable material, and a sheath-core composite yarn in which the above polymer was a core and polyhexamethylene terephthalate was a sheath was jetted at 200° C. from 8 holes.

In Example 5, Example 4 was repeated except that 10 parts of the same thermally color-changeable material as used in Example 1 was melt-mixed at 170° C. with 90 parts of chips of polyhexamethylene terephthalate having a melting point of 149° C. to obtain chips containing the color-changeable material and this polymer was made a core.

In both Examples 4 and 5, there were obtained thermally color-changeable fabrics excellent in color-changeability and color-formability, showing no whitish color in color formation and having washing durability.

COMPARATIVE EXAMPLES 1 and 2

In Comparative Example 1, Example 1 was repeated except that the sheath and core components were inversely arranged such that the thermally color-changeable mixed chipes (phase A) were a sheath and polybutylene terephthalate was a core.

Fiberizability was good, but color-formability was poor and a whitish color was shown in color formation.

In Comparative Example 2, Example 1 was repeated except that a sheath-core mixing ratio was changed into core:sheath = 83:17. Yarns were often broken and fiberizability was poor.

EXAMPLES 6 and 7

A thermally color-changeable composition comprising a melt of 3-diethylamino-7,8-benzfluoran, bisphenol A and stearyl alcohol was microcapsulated by epoxy resin/amine interfacial polymerization to afford a thermally color-changeable material having an average particle size of 2 to 15 micrometers.

Subsequently, 30 parts of the thermally color-changeable material was melt-mixed at 195° C. with 70 parts of chips of a polyamide elastomer (PEBAX 3533SNOO, a tradename for a product of Toray Industries, Inc.) having a melting point of 152° C. to obtain chips (phase A) containing the color-changeable material. Thereafter, Example 1 was repeated except that a sheath-core composite yarn in which the chips (phase A) were a core and nylon 6 (phase B) was a sheath and a sheath:core composite ratio was 50:50 by weight was spun at from 8 holes and wound up at a spinning rate of 400 m/min. The resulting filaments were 90 denier/6 filaments.

Figure 4:
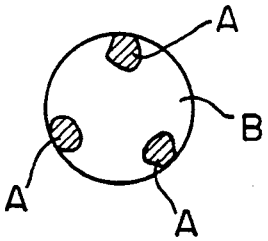
Figure 5:
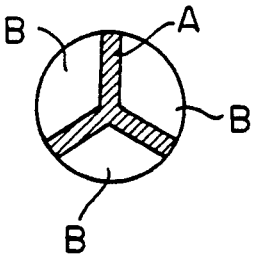
Figure 6:
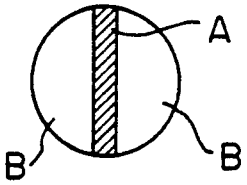

In Example 7, Example 6 was repeated except that the sectional form was as shown in FIG. 4 and a phase A:phase B composite ratio was 40:60 by weight.

In both Examples 6 and 7, the resulting fabrics were colorless above 50° C. and pink below 50° C., were excellent in color-changeability, color-formability and washing durability, and showed no whitish color. However, the fabric in Example 7 was inferior to those in the foregoing Examples in color-formability and color-changeability, and somewhat whitish in color formation.

EXAMPLES 8 and 9

In Example 8, Example 1 was repeated except that the sectional form was as shown in FIG. 2 and a phase A:phase B composite ratio was 20:80.

In Example 9, Example 1 was repeated except that the sectional form was as shown in FIG. 3 and a phase A:phase B composite ratio was 40:60.

In both Examples 8 and 9, there were obtained thermally color-changeable fabrics excellent in color-formability, color-changeability and washing durability and showing no whitish color in color formation.

COMPARATIVE EXAMPLES 3 and 4

In Comparative Example 3, only the same polypropylene containing the thermally color-changeable material as used in Example 4 was fiberized. Spinnability was good but filaments were often broken in a stretching step. Color-formability was somewhat poor and a dull whitish color was seen in color formation.

In Comparative Examples 4, 10 parts of the same thermally color-changeable material as used in Example 1 was melt-mixed with 90 parts of common polyethylene terephthalate having a melting point of 258° C. A decomposed gas was generated in kneading, and satisfactory pigment-containing chips could not be obtained.

EXAMPLE 10

Example 1 was repeated except that polyethylene terephthalate (melting point 220° C.) modified with 15 mol% of isophthalic acid was used in a sheath and a spinning temperature was changed into 235° C. There was obtained a thermally color-changeable fabric having good fiberizability and good color-formability, showing no whitish color in color formation and having excellent washing durability.

EXAMPLE 11

Example 1 was repeated except that polybutylene terephthalate (melting point 168° C.) modified with 35 mol% of isophthalic acid) was used as a polymer for phase A, polybutylene terephthalate (melting point 177° C.) modified with 30 mol% of isophthalic acid was used as a polymer for phase B, and a spinning temperature was changed into 200° C. There was obtained a thermally color-changeable fabric having very good fiberizability and very good color-formability, showing no whitish color in color formation and having excellent washing durability.

The production conditions and the results in said Examples and Comparative Examples are shown in Table 1.

In Table 1, ◎ indicates "very good", ○ "good", Δ "not necessarily good", and X "poor", respectively.

TABLE 1

| | Thermally color-changeable polymer phase (phase A) | | | | | | Protective polymer phase (phase B) | A/B mixing ratio | Sectional view |
|---|---|---|---|---|---|---|---|---|---|
| | Thermoplastic polymer | melting point (°C.) | Thermally color-changeable material (I) | (II) | (III) | Amount | | | |
| Example 1 | polyethylene | 140 | crystal violet lactone | bis-phenol A | cetyl alcohol | 20 | polybutylene terephthalate | 50:50 | FIG. 1 |
| Example 2 | polyethylene | 140 | crystal violet lactone | bis-phenol A | cetyl alcohol | 20 | nylon 6 | 50:50 | FIG. 1 |
| Example 3 | polyethylene | 140 | crystal violet lactone | bis-phenol A | cetyl alcohol | 20 | polyhexamethylene terephthalate | 50:50 | FIG. 1 |
| Example 4 | polypropylene | 165 | crystal violet lactone | bis-phenol A | cetyl alcohol | 20 | polyhexamethylene terephthalate | 50:50 | FIG. 1 |
| Example 5 | polyhexa-methylene terephthalate | 149 | crystal violet lactone | bis-phenol A | cetyl alcohol | 10 | polyhexamethylene terephthalate | 50:50 | FIG. 1 |
| Comparative Example 1 | polyethylene | 140 | crystal violet lactone | bis-phenol A | cetyl alcohol | 20 | polybutylene terephthalate | 50:50 | core/sheath |
| Comparative Example 2 | polyethylene | 140 | crystal violet lactone | bis-phenol A | cetyl alcohol | 20 | polybutylene terephthalate | 83/17 | FIG. 1 |
| Example 6 | polyamide elastomer | 152 | 3-diethylamino-7,8-benzfluoran | bis-phenol A | stearyl alcohol | 30 | nylon 6 | 50/50 | FIG. 1 |
| Example 7 | polyamide elastomer | 152 | 3-diethylamino-7,8-benzfluoran | bis-phenol A | stearyl alcohol | 30 | nylon 6 | 40/60 | FIG. 4 |
| Example 8 | polyethylene | 140 | crystal violet lactone | bis-phenol A | cetyl alcohol | 20 | polybutylene terephthalate | 20/80 | FIG. 2 |
| Example 9 | polyethylene | 140 | crystal violet lactone | bis-phenol A | cetyl alcohol | 20 | polybutylene terephthalate | 40/60 | FIG. 3 |
| Comparative Example 3 | polypropylene | 165 | crystal violet lactone | bis-phenol A | cetyl alcohol | 20 | — | 100/0 | single |
| Comparative Example 4 | polyethylene terephthalate | 258 | crystal violet lactone | bis-phenol A | cetyl alcohol | 10 | — | — | — |
| Example 10 | polyethylene | 140 | crystal violet lactone | bis-phenol A | cetyl alcohol | 20 | polyethylene terephthalate modified with 15 mol % of isophthalic acid | 50/50 | FIG. 1 |
| Example 11 | polybutylene terephthalate modified with 35 mol % of isophthalic acid | 168 | crystal violet lactone | bis-phenol A | cetyl alcohol | 20 | polybutylene terephthalate modified with 30 mol % of isophthalic acid | 50/50 | FIG. 1 |

| | Color-formability | Absence of whitish color in color | Durability (Color-formability |
|---|---|---|---|

TABLE 1-continued

| | Fiberizability | Color-changeability | formation (gloss) | after washing 50 times) | Overall estimation | Remarks |
|---|---|---|---|---|---|---|
| Example 1 | ◎ | ○ | ◎ | ○ | ○-◎ | Polymer phase A is a core. |
| Example 2 | ◎ | ○ | ◎ | ○ | ○-◎ | |
| Example 3 | ◎ | ◎ | ◎ | ◎ | ◎ | |
| Example 4 | ◎ | ◎ | ◎ | ◎ | ◎ | |
| Example 5 | ◎ | ◎ | ◎ | ◎ | ◎ | |
| Comparative Example 1 | ◎ | Δ-X | X | Δ-X | Δ-X | Polymer phase A is a sheath. |
| Comparative Example 2 | X | — | ○ | — | X | A ratio of polymer phase B is lower. |
| Example 6 | ◎ | ○ | ◎ | ○ | ○-◎ | |
| Example 7 | ◎ | ○ | Δ | ○ | ○-◎ | |
| Example 8 | ◎ | ○-◎ | ◎ | ○-◎ | ○-◎ | |
| Example 9 | ◎ | ○-◎ | ◎ | ○-◎ | ○-◎ | |
| Comparative Example 3 | Δ-X | Δ | X | Δ | Δ-X | Fine denier is impossible. |
| Comparative Example 4 | X | X | — | — | X | Decomposition occurs in kneadiry. |
| Example 10 | ○-◎ | ○ | ○ | ○ | ○ | |
| Example 11 | ◎ | ◎ | ◎ | ◎ | ◎ | |

EXAMPLES 12 to 14

Using a dye bath containing 3.0% owf of Sumipon UL (benzotriazole-type) as an ultraviolet absorber and 0.1% owf of a yellow dispersion dye (Kayalon Polyester Yellow YL-SE), plane weave were dyed as in Examples 1, 4 and 5 at 100° C. for 30 minutes under a condition of a bath ratio = 1:50. In all of these Examples, the temperature-sensitive color-changeable fibers contained about 3%, based on the weight of the fibers, of the ultraviolet absorber.

As a result, the resulting dyed products were yellowish green at room temperature. When the temperature was raised to 40° C. or higher, they became yellow. Said products were thus excellent in color-formability and color-changeability, showed no whitish color in color formation and had excellent washing durability. Light irradiation was carried out at 63° C. by a carbon fadeometer to evaluate temperature-sensitivity. As a result, even after 20 times (irradiation period of time), excellent temperature-sensitivity was maintained.

Effects of the Invention

This invention can realize a thermally color-changeable fiber excellent in color-changeability, color-formability, washing durability and light resistance and showing no whitish color in color formation by forming a thermoplastic polymer containing a given amount of a thermally color-changeable material and a fiber-forming thermplastic polymer into a composite fiber of a specific structure. Moreover, this invention can drastically improve light resistance in temeprature sensitivity by adding an ultraviolet absorber to the fiber.

What we claim is:

1. A temperature-sensitive color-changeable composite fiber, comprising a thermally color-changeable polymer phase (phase A) consisting essentially of a thermally color-changeable material which comprises an electron donating organic compound, an electron-accepting compound, and a compound as a reaction medium for the electron-donating and electron-accepting compounds; and a thermoplastic polymer having a melting point or a softening point of 230° C. or lower, the content of the thermally color-changeable material being 0.5 to 90% by weight and (B) a protective polymer phase (phase B) consisting essentially of a fiber-forming thermoplastic polymer contacting the thermally color-changeable polymer phase (phase a), wherein (i) the protective polymer phase (phase B) occupies at least 69% of the fiber surface area, and (ii) the protective polymer phase (phase b) occupies 20 to 95% by weight relative to the overall weight of the fiber.

2. The composite fiber of claim 1 wherein the content of the thermally color-changeable material in the thermally color-changeable polymer phase (phase A) is 1 to 70% by weight.

3. The composite fiber of claim 1 wherein the protective polymer phase (phase B) in the composite fiber occupies at least 80% of the fiber surface area.

4. The composite fiber of claim 1 wherein the protective polymer phase (phase B) in the composite fiber occupies 25 to 90% by weight relative to the overall fiber.

5. The composite fiber of claim 1 wherein the thermoplastic polymer forming the thermally color-changeable polymer phase (phase A) is at least one type selected from the group consisting of polyethylene, polypropylene, polyhexamethylene terephthalate, polybutylene terephthalate, nylon 6, nylon 12 and a copolymer thereof.

6. The fiber of claim 1 wherein at least the protective polymer phase (phase B) contains an ultraviolet absorber.

7. The composite fiber of claim 1 wherein the thermoplastic polymer forming the protective polymer phase (phase B) is at least one type selected from the group consisting of polyethylene terephthalate, polybutylene terephthalate, polyhexamethylene terephthalate, nylon 6, nylon 66, nylon 12 and a copolymer thereof.

8. The composite fiber of claim 1 which has a sheath-core structure that the thermally color-changeable polymer phase (phase A) forms a core and the protective polymer phase (phase B) forms a sheath.

9. The composite fiber of claim 1 wherein the thermoplastic polymers forming the thermally color-changeable polymer phase (phase A) and the protective polymer phase (phase B) are both polybutylene terephthalate polymers, and the melting point of the thermoplastic polymer forming the thermally color-changeable polymer phase (phase A) is lower than that of the thermoplastic polymer forming the protective polymer phase (phase B).

* * * * *

UNITED STATES PATENT AND TRADEMARK OFFICE

CERTIFICATE OF CORRECTION

PATENT NO. : 5,153,066

DATED : October 6, 1992

INVENTOR(S) : Kazuhiko Tanaka, et al

It is certified that error appears in the above-indentified patent and that said Letters Patent is hereby corrected as shown below:

COLUMN 5

Line 15, "cource," should read --course,--.
Line 47, "(phases A)" should read --(phase A)--.

COLUMN 6

Line 45, "as such," should read --such as--.

COLUMN 7

Line 47, "diagramatic" should read --diagrammatic--.

COLUMN 8

Line 13, "decreases to stop decrease" should read --is reduced to stop the loss--.
Line 14, "comes to be lost" should read --is poor--.
Line 49, "paras-" should read --parachutes,--.
Line 50, "hutes," should be deleted.

COLUMN 9

Line 11, "tempearsture." should read --temperature.--.

COLUMN 10

Line 30, "chipes" should read --chips--.
Line 55, "at" should be deleted.

COLUMN 11

Line 21, "Examples 4," should read --Example 4,--.

UNITED STATES PATENT AND TRADEMARK OFFICE

CERTIFICATE OF CORRECTION

PATENT NO. : 5,153,066

DATED : October 6, 1992

INVENTOR(S) : Kazuhiko Tanaka, et al

It is certified that error appears in the above-indentified patent and that said Letters Patent is hereby corrected as shown below:

COLUMN 12

Line 15, "acid)" should read --acid--.

COLUMN 13

Line 52, "thermplastic" should read --thermoplastic--.
Line 54, "temeprature" should read --temperature--.
Line 58, "comprising a" should read --comprising (A) a--.

COLUMN 14

Line 24, "a)," should read --A),--.
Line 26, "69%" should read --60%--.
Line 27, "(phase b)" should read --(phase B)--.
Line 58, "structure that" should read --structure such that--.

Signed and Sealed this

Eighteenth Day of October, 1994

*Attest:*

*Attesting Officer*

BRUCE LEHMAN

*Commissioner of Patents and Trademarks*